United States Patent [19]

Welp et al.

[11] 4,199,249

[45] Apr. 22, 1980

[54] METHOD AND APPARATUS FOR DUPLICATING BY MEANS OF AMMONIA GAS

[75] Inventors: Ulrich Welp, Bad Nauheim; Jüergen Sahlmann, Woelfersheim, both of Fed. Rep. of Germany

[73] Assignee: Microbox Dr. Welp Gesellschaft mit beschraenkter Haftung and Company, Bad Nauheim, Fed. Rep. of Germany

[21] Appl. No.: 830,819

[22] Filed: Sep. 6, 1977

[30] Foreign Application Priority Data

Sep. 23, 1976 [AT] Austria ..... 167077/76

[51] Int. Cl.[2] ..... G03D 7/00

[52] U.S. Cl. ..... 354/299; 354/300; 354/317; 34/219

[58] Field of Search ..... 354/299, 300, 324, 317; 34/23, 26, 36, 37, 155, 219; 96/49

[56] References Cited

U.S. PATENT DOCUMENTS

| | | | |
|---|---|---|---|
| 1,904,551 | 4/1933 | Smith | 34/219 |
| 3,364,833 | 1/1968 | Mulvany | 354/300 |
| 3,524,397 | 8/1970 | Hruby | 34/219 |
| 3,535,997 | 10/1970 | Blake | 34/219 |
| 3,720,150 | 3/1973 | Hurtig et al. | 354/300 |
| 3,900,862 | 8/1975 | Bennett et al. | 354/300 |
| 3,915,708 | 10/1975 | Zausmer et al. | 354/300 |
| 3,986,191 | 10/1976 | Ackerman et al. | 354/300 |
| 4,010,478 | 3/1977 | Jantzen | 354/300 |
| 4,048,645 | 9/1977 | Reams | 354/324 |

FOREIGN PATENT DOCUMENTS

| | | | |
|---|---|---|---|
| 1365759 | 4/1973 | United Kingdom | 354/300 |

*Primary Examiner*—L. T. Hix
*Assistant Examiner*—Alan Mathews
*Attorney, Agent, or Firm*—W. G. Fasse; D. F. Gould

[57] ABSTRACT

Copies or duplicates are made from a suitable original such as a silver film or a diazofilm onto a further diazofilm by circulating the ammonia gas in a closed, evacuated circuit including the developing chamber. The ammonia gas is compressed in the developing chamber and expanded again as it is returned to a heatable supply chamber. The apparatus includes a closed circuit arrangement between the supply chamber and the developing chamber as well as an evacuating device connected to the developing chamber.

9 Claims, 1 Drawing Figure

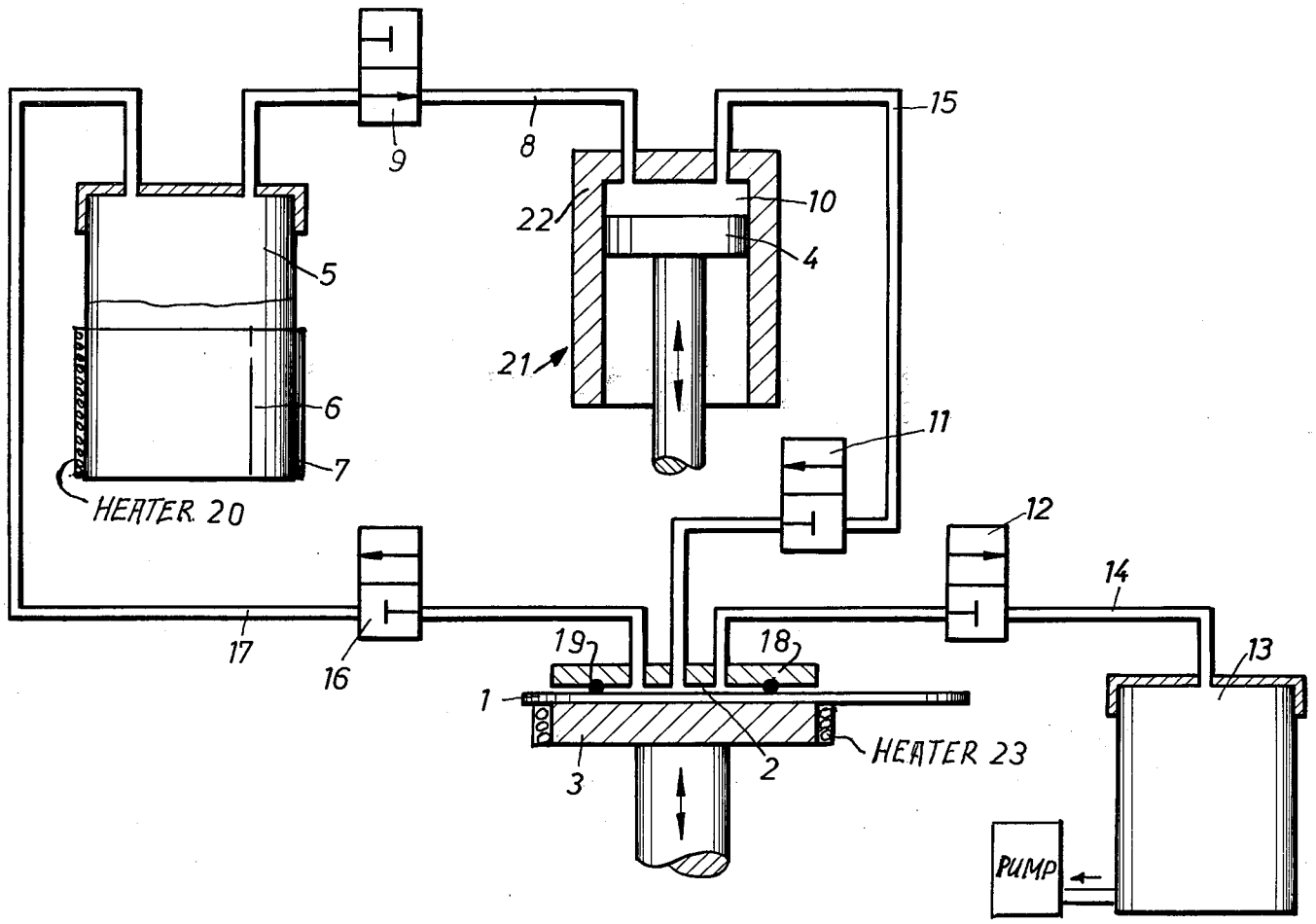
PUMP
HEATER 23
HEATER 20
1
2
3
4
5
6
7
8
9
10
11
12
13
14
15
16
17
18
19
21
22

METHOD AND APPARATUS FOR DUPLICATING BY MEANS OF AMMONIA GAS

BACKGROUND OF THE INVENTION

The invention relates to a method and apparatus for making copies or duplicating from a suitable original such as a silver film or a diazofilm onto a diazo duplicate film, whereby ammonia gas is used for the developing.

It is known in the art to duplicate silver film onto a diazo duplicate film employing the principle of heliographic or so-called blueprint copying machines, whereby the duplicating film is exposed and thereafter developed in ammonia gas. The ammonia gas is produced by evaporating of ammonia water or ammonia crystals. This type of prior art method requires for its performance a substantial length of time.

It is further known to develope the diazofilm in the course of the prior art blueprinting under a high gas pressure, for example, six atmospheres gauge pressure. Due to the pressure application the development time is reduced so that one duplicate copy may be made per second.

The gas required for the performance of the prior art methods in producing the high pressure is obtained from commercially available gas bottles which are returned for a refill when their content is used up. Another disadvantage of the prior art development method is seen in that the amonia gas which has not been used up and which escapes when the developing chamber is opened must either be sucked-off or it must be collected in a container holding an absorber liquid. The installation of equipment for sucking off the ammonia gas not used up, is cumbersome. The frequent changing of the absorber liquid is expensive.

OBJECTS OF THE INVENTION

In view of the above it is the aim of the invention, to achieve the following objects singly or in combination:

- to avoid the drawbacks of the prior art, more specifically, to reduce the time required for making each blueprint copy;
- to avoid the waste of ammonia gas;
- to provide a method and aparatus for making blueprints which is operable by using ammonia water which is readily available;
- to provide a method and aparatus wherein the ammonia gas is circulated in a closed circuit so that the operation is more economical than heretofore; and
- to avoid the development of obnoxious odors, which are prevalent in prior art methods while simultaneously avoiding the sucking off of the ammonia gas as well as avoiding the use of an absorption means.

SUMMARY OF THE INVENTION

According to the invention there is provided a method for duplicating a suitable original onto a diazofilm by means of ammonia gas comprising the steps of employing a closed flow circuit for said ammonia gas including a heatable ammonia gas supply container and a developing chamber; evacuating said closed circuit, circulating ammonia gas from said gas supply container to said developing chamber and back to said container, and compressing and expanding said ammonia gas in said developing chamber.

According to the invention there is further provided an apparatus for duplicating a suitable original onto a diazofilm by means of ammonia gas comprising an evacuable supply container means for ammonia water, means for the suction and compression of ammonia gas, evacuable developing chamber means, conduit means operatively interconnecting said container means, said suction and compression means, and developing chamber means to form a closed circuit system, and valve means operatively arranged in said closed circuit system between said container means and said suction and compression means as well as between the latter and said developing chamber means and between the developing chamber means and said container means.

Preferably, the developing chamber is evacuated according to the invention prior to the entry of ammonia gas into the developing chamber. It is further preferable to heat the ammonia gas in the developing chamber. Such heating should bring the temperature of the ammonia gas to a value within the range of about 30° C. to about 60° C.

BRIEF FIGURE DESCRIPTION

In order that the invention may be clearly understood, it will now be described, by way of example, with reference to the accompanying drawings in which the single FIGURE illustrates a block diagram of the present apparatus including the closed flow circuit for the ammonia gas.

DETAILED DESCRIPTION OF A PREFERRED EXAMPLE EMBODIMENT

The duplicating or copied card or sheet 1 is exposed through a suitable original. The original may be a silver film or another diazofilm similar to the duplicated copy or sheet 1. The copy 1 is inserted into the developing chamber 2 either by hand or automatically as is known in the art. When the copy 1 is inserted into the developing chamber 2 the latter is closed by moving the bottom plate 3 against the top portion 18 of the developing chamber 2. The chamber 2 is sealed by a sealing ring 19 when the bottom plate 3 presses against the top portion 18 by means not shown but capable of moving the bottom plate 3 up and down.

The closed circuit system further comprises a supply container 7 for the ammonia in the form of ammonia water 6 in the container 7 which is heatable by a heater 20, such as heatng coils or the like known as such.

The closed circuit system further includes a piston cylinder arrangement 21 including a piston 4 movable up and down by conventional means as shown by the arrow.

First conduit means connect an outlet port of the container 7 to an inlet port of the cylinder 22 through a valve 9. Second conduit means 15 connect the developing chamber 2 to an outlet port of the cylinder chamber 10, again through a valve 11. Third conduit means 17 interconnect the developing chamber 2 to an inlet port of the container 7 through a valve 16, thereby completing the closed circuit.

An evacuating device 13, for instance, evacuable by a conventional pump is operatively connected to the developing chamber 2 by a fourth conduit 14 including a valve 12. Incidentally, the developing chamber 2 is also heatable by a conventional heater 23. Preferably, the chamber 2 with its top portion 18 is stationary and the bottom plate 3 is movable.

In operation, when the piston 4 in the chamber 10 moves downwardly, ammonia gas is sucked through the conduit 8 into the chamber 10 of the compressor which is shown as a piston cylinder arrangement 21. The container 7 which is heatable,, is substantially evacuated and filled to about 75% with ammonia water 6. If the stroke of the piston 4 is completed downwardly, the valve 9 is closed. The control of the valve 9 may be accomplished in any suitable, conventional manner, for example, by magnetic means responsive to the piston movement.

During the suction stroke of the piston 4, the valve 12 is temporarily opened for a short period of time, whereby the continuously evacuated container 13 substantially evacuates the developing chamber 2 through the conduit 14 and said valve 12. If the piston 4 now moves upwardly, while the valve 9 is closed, it compresses the ammonia gas sucked into the pump chamber 10 and, after opening of the valve 11 the ammonia gas is supplied into the developing chamber 2 under pressure through the conduit 15 and the valve 11. When the piston 4 completes its upward stroke, the valve 11 is closed, again by conventional means. When the time duration for the developing is completed, the valve 16 is opened in the conduit 17 between the developing chamber 2 and the supply container 7, whereby the ammonia gas under pressure in the developing chamber 2 is expanded. Subsequent to the expansion the vacuum 5 in the container 7 sucks the remaining ammonia gas out of the developing chamber 2, whereupon the valve 16 is closed again and the plate 3 moves downwardly so that the duplicate card or copy 1 may be removed from the developing chamber 2. Such removal may be accomplished automatically.

Thereafter the valve 9 is opened again and the apparatus is in its starting position so that the work cycle may be repeated for a further copy or duplicate card 1.

Advantages of the invention are seen in that it is now possible to use ammonia water for obtaining the ammonia gas necessary for the developing of diazofilms. Such ammonia water is readily available, for example, in a solution comprising about 75% $H_2O$ and about 25% $NH_3$.

The compression of the ammonia gas involves a relatively high pressure of, for example, six atmospheres gauge pressure whereby simultaneously the compressed gas is heated by the heater 23 resulting in a rapid development of the diazofilms, for example, the development time according to the invention is about 1 sec.

By maintaining the ammonia gas in a closed circuit system it is possible to retrieve the ammonia gas which is not used up in the developing process, by returning it into the container 7 holding the ammonia water, whereby an optimal utilization of the $NH_3$ is accomplished. For example, it should be mentioned here that from about $350^3$ cm of ammonia water an equal number of $cm^3$ of $NH_3$ may be obtained which is comparable to the ammonia supply from a bottle containing 0.9 kg liquified ammonia. The method according to the invention is thus much more economical as far as the use of $NH_3$ is concerned, whereby substantial savings as compared to the prior art are accomplished. Another advantage is seen in that no odor development is present in the environment where an apparatus according to the present invention is operated. Moreover, a sucking off or removing of the gasses into an absorption means is also obviated according to the invention.

In view of the foregoing, it will be appreciated that the invention is not limited to duplicating from a silver film original onto a diazo copy film because it is possible without difficulties to copy from one diazofilm original to another diazofilm. Thus, it is intended, to cover all modifications and equivalents within the scope of the appended claims.

What is claimed is:

1. A method for developing a diazofilm by means of ammonia gas, comprising the steps of employing a closed flow circuit for said ammonia gas, including in said closed flow circuit a heatable and evacuable ammonia gas supply container partially filled with a liquid ammonia supply, and an evacuable developing chamber, evacuating by means of a pump the space in said supply container above liquid ammonia supply in said container to pressures below atmospheric pressure to thereby withdraw ammonia gas from said supply container, compressing said ammonia gas withdrawn from said evacuated ammonia gas supply container by the same pump to charge ammonia gas under increased pressure in excess of about 6 atmospheres gauge into said developing chamber, developing said diazofilm under said increased pressure and expanding said ammonia gas in said developing chamber back into said evacuated ammonia gas supply container.

2. The method of claim 1, further comprising evacuating said developing chamber prior to entering of ammonia gas into said developing chamber.

3. The method of claim 2, wherein said evacuation provides a vacuum within the gauge pressure range of −0,3 to −0,6 bar

4. The method of claim 1, further comprising heatng the ammonia gas in the developing chamber to a temperature within the range of about 30° C. to 60° C.

5. The method of claim 1, wherein said ammonia gas in said supply container is heated to a temperature within the range of about 30° C. to about 60° C.

6. An apparatus for developing a diazofilm by means of ammonia gas, comprising an evacuable supply container means (7) for ammonia water, suction and compression pump means (21) operatively evacuating said supply container means, evacuable developing chamber means, first conduit means operatively interconnecting the space above the ammonia water in said supply container means, and said developing chamber means and second conduit means operatively interconnecting said developing chamber means and said supply container means, to form a closed circuit system, and valve means operatively arranged in said closed circuit system between said container means and said suction and compression pump means as well as between the latter and said developing chamber means and between the developing chamber means and said container means, said suction and compression pump means being located in said first conduit means downstream of said supply container means as viewed in the flow direction, whereby the same pump keeps the supply container means evacuated to a pressure below atmospheric pressure and the developing chamber at an increased pressure above at least about 6 atmospheres gauge during the developing.

7. The apparatus of claim 6, further comprising heater means for said container means and for said developing chamber means.

8. The apparatus of claim 6, further comprising evacuating means, conduit means operatively connecting said evacuating means to said developing chamber means, and valve means in said conduit means.

9. The method of claim 1, wherein said ammonia supply is ammonia water.

* * * * *